US011377706B2

(12) United States Patent
Okabe et al.

(10) Patent No.: US 11,377,706 B2
(45) **Date of Patent: *Jul. 5, 2022**

(54) DEVICE TO IMPROVE IRON LOSS PROPERTIES OF GRAIN-ORIENTED ELECTRICAL STEEL SHEET

(71) Applicant: JFE STEEL CORPORATION, Tokyo (JP)

(72) Inventors: Seiji Okabe, Tokyo (JP); Shigehiro Takajo, Tokyo (JP); Yasushi Kitani, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 145 days.

This patent is subject to a terminal disclaimer.

(21) Appl. No.: 16/901,328

(22) Filed: Jun. 15, 2020

(65) Prior Publication Data

US 2020/0332380 A1 Oct. 22, 2020

Related U.S. Application Data

(62) Division of application No. 14/362,935, filed as application No. PCT/JP2012/008267 on Dec. 25, 2012, now Pat. No. 10,745,773.

(30) Foreign Application Priority Data

Dec. 27, 2011 (JP) ..... 2011-286374

(51) Int. Cl.
*C21D 8/12* (2006.01)
*C22C 38/04* (2006.01)
(Continued)

(52) U.S. Cl.
CPC ..... *C21D 8/1244* (2013.01); *C21D 8/1294* (2013.01); *C22C 38/00* (2013.01);
(Continued)

(58) Field of Classification Search
CPC .... C21D 8/1244; C21D 8/1294; C22C 38/00; C22C 38/001; C22C 38/02; C22C 38/04; C22C 38/06; C22C 38/60; H01F 41/00
(Continued)

(56) References Cited

U.S. PATENT DOCUMENTS 2,473,156 A 6/1949 Littmann
3,154,371 A * 10/1964 Johnson ..... G09G 3/02 347/248

(Continued)

FOREIGN PATENT DOCUMENTS

CN 101297050 10/2008
CN 101492765 7/2009

(Continued)

OTHER PUBLICATIONS

Chinese Office Action dated Aug. 13, 2015 issued in the Chinese Patent Office in corresponding Chinese patent application No. 201280064470.3 with English translation of Chinese Office Action.

(Continued)

*Primary Examiner* — Jimmy Chou
(74) *Attorney, Agent, or Firm* — Nixon & Vanderhye

(57) ABSTRACT

This device scans a high-energy beam in a direction traversing a feed path of a grain-oriented electrical steel sheet having subjected to final annealing so as to irradiate a surface of the steel sheet being passed through with the high-energy beam to thereby perform magnetic domain refinement, the device including an irradiation mechanism for scanning the high-energy beam in a direction orthogonal to the feed direction of the steel sheet, in which the irradiation mechanism has a function of having the scanning direction of the high-energy beam oriented diagonally, rela- (Continued)

tive to the orthogonal direction, toward the feed direction at an angle determined based on a sheet passing speed of the steel sheet on the feed path.

2 Claims, 4 Drawing Sheets

(51) Int. Cl.
*C22C 38/60* (2006.01)
*C22C 38/00* (2006.01)
*C22C 38/02* (2006.01)
*C22C 38/06* (2006.01)
*H01F 41/00* (2006.01)

(52) U.S. Cl.
CPC ..... *C22C 38/001* (2013.01); *C22C 38/02* (2013.01); *C22C 38/04* (2013.01); *C22C 38/06* (2013.01); *C22C 38/60* (2013.01); *H01F 41/00* (2013.01)

(58) Field of Classification Search
USPC ..... 219/121.29, 121.12, 121.18, 121.39, 219/121.67
See application file for complete search history.

(56) References Cited

U.S. PATENT DOCUMENTS 3,990,923 A 11/1976 Takahina
4,063,063 A 12/1977 Funck
4,293,350 A * 10/1981 Ichiyama ..... C21D 8/1294 148/111
4,456,812 A * 6/1984 Neiheisel ..... B23K 26/0821 219/121.85
4,468,551 A * 8/1984 Neiheisel ..... B23K 26/0846 219/121.6
4,500,771 A * 2/1985 Miller ..... B23K 26/0846 219/121.68
4,535,218 A * 8/1985 Krause ..... B23K 26/073 219/121.68
4,750,949 A 6/1988 Kobayashi
4,956,539 A * 9/1990 Uesugi ..... B23K 26/0821 219/121.8
5,013,373 A 5/1991 Block
5,026,439 A * 6/1991 Tanaka ..... C21D 9/52 148/111
5,072,091 A * 12/1991 Nagata ..... B23K 26/073 219/121.68
5,103,074 A * 4/1992 Watanabe ..... B23K 26/0736 219/121.75
5,185,043 A 2/1993 Nishike
5,223,048 A * 6/1993 Inokuti ..... C21D 8/1294 148/307
5,229,573 A 7/1993 Stone
5,229,574 A 7/1993 Stone
5,294,771 A * 3/1994 Pratt ..... B23K 15/02 219/121.14
5,296,051 A * 3/1994 Inokuti ..... C21D 8/1294 148/111
5,382,802 A * 1/1995 Anabuki ..... C21D 8/1294 219/121.83
5,691,839 A * 11/1997 Kobayashi ..... G02B 21/0048 348/E3.053
5,801,356 A * 9/1998 Richman ..... B23K 26/18 219/121.68
5,961,860 A * 10/1999 Lu ..... B08B 7/0042 219/121.65
5,994,665 A * 11/1999 Nishibayashi ..... B23K 26/067 219/121.64
6,263,714 B1 * 7/2001 Johnson ..... B21B 37/66 72/10.3
6,291,796 B1 * 9/2001 Lu ..... B08B 7/0042 219/121.68
6,300,593 B1 * 10/2001 Powell ..... B23K 26/0846 219/121.67
6,331,692 B1 * 12/2001 Krause ..... B23K 26/04 219/121.67
6,368,424 B1 * 4/2002 Sakai ..... C21D 8/1294 148/111
6,666,929 B1 * 12/2003 Ban ..... C21D 8/1294 148/111
7,045,025 B2 5/2006 Hamamura
7,442,260 B2 * 10/2008 Sakai ..... C21D 8/1294 148/110
7,655,881 B2 * 2/2010 Tanaka ..... G02B 27/0966 219/121.65
7,763,120 B2 7/2010 Sakai et al.
7,883,586 B2 * 2/2011 Sakai ..... C21D 8/12 148/111
8,016,951 B2 9/2011 Arai
8,202,374 B2 6/2012 Kumano
8,277,574 B2 * 10/2012 Sakai ..... H01F 1/16 148/113
8,502,110 B2 * 8/2013 Lin ..... B23K 26/0676 219/121.62
8,773,647 B2 * 7/2014 Park ..... G01P 3/68 356/28.5
8,921,732 B2 * 12/2014 Costin ..... B23K 26/082 219/121.6
9,346,123 B2 5/2016 Okabe
9,604,312 B2 * 3/2017 Huang ..... B23K 26/362
10,092,979 B2 * 10/2018 Suzuki ..... B23K 26/0006
11,000,920 B2 * 5/2021 Lee ..... B23K 26/354
2003/0116236 A1 6/2003 Hayakawa
2003/0116545 A1 * 6/2003 Kaji ..... B26D 7/10 219/121.72
2003/0168437 A1 9/2003 Tanaka
2003/0178397 A1 * 9/2003 Jendick ..... B23K 26/0846 219/121.69
2003/0224587 A1 * 12/2003 Yamazaki ..... G02B 19/0014 438/487
2004/0040629 A1 * 3/2004 Hamamura ..... C21D 8/1294 148/110
2006/0169362 A1 8/2006 Sakai
2006/0219676 A1 * 10/2006 Taylor ..... G02B 6/107 219/121.69
2008/0083715 A1 * 4/2008 Kirmeier ..... B23K 26/0846 219/121.69
2008/0210667 A1 9/2008 Yang
2009/0031870 A1 * 2/2009 O'Connor ..... B23K 26/0846 83/13
2009/0107585 A1 * 4/2009 Sakai ..... B23K 26/0006 148/121
2009/0114316 A1 5/2009 Sakai et al.
2009/0282884 A1 * 11/2009 Pawelski ..... B21B 37/44 72/201
2010/0272961 A1 10/2010 Costin
2011/0095001 A1 * 4/2011 Loewer ..... B23K 15/02 219/121.14
2011/0297655 A1 * 12/2011 Ueda ..... G02B 26/121 219/121.67
2012/0205354 A1 * 8/2012 Kudoh ..... B23K 26/355 219/121.69
2013/0032580 A1 * 2/2013 Yokoi ..... B23K 26/0876 219/121.6
2013/0133783 A1 * 5/2013 Yamaguchi ..... H01F 1/16 148/307
2013/0143050 A1 * 6/2013 Omura ..... C22C 38/08 428/450
2013/0161301 A1 * 6/2013 Okabe ..... C22C 38/008 219/121.85
2013/0284711 A1 * 10/2013 Huang ..... C21D 8/12 219/121.69
2014/0126167 A1 * 5/2014 Bozorgi ..... B23K 26/206 361/760
2014/0312009 A1 * 10/2014 Okabe ..... C22C 38/00 219/121.29

(56) References Cited

U.S. PATENT DOCUMENTS

| | | | | |
|---|---|---|---|---|
| 2017/0173735 | A1* | 6/2017 | Hsu | B23K 35/36 |
| 2018/0017868 | A1* | 1/2018 | Suehiro | G03F 7/038 |
| 2019/0151998 | A1* | 5/2019 | Dallan | B23K 26/0869 |

FOREIGN PATENT DOCUMENTS

| | | |
|---|---|---|
| CN | 102046323 | 5/2011 |
| EP | 0274538 | 7/1988 |
| EP | 1953249 | 8/2008 |
| JP | 57-2252 | 1/1982 |
| JP | 58-19440 | 2/1983 |
| JP | 61-48528 | 3/1986 |
| JP | 61-203421 | 9/1986 |
| JP | 01-298118 | 12/1989 |
| JP | 04-59930 | 2/1992 |
| JP | 05-43944 | 2/1993 |
| JP | 06-72266 | 9/1994 |
| JP | 07-238321 | 9/1995 |
| JP | 10-204533 | 8/1998 |
| JP | 10-298654 | 11/1998 |
| JP | 11-279645 | 10/1999 |
| JP | 2000-336430 | 12/2000 |
| JP | 2006-117964 | 5/2006 |
| JP | 2006-144058 | 6/2006 |
| JP | 2007-277644 | 10/2007 |
| JP | 2010-155278 | 7/2010 |
| RU | 2 371 487 | 10/2009 |
| WO | 2011125672 | 10/2011 |

OTHER PUBLICATIONS

Russian Office Action dated Oct. 20, 2015 issued in the Russian Patent Office in corresponding Russian patent application No. 2014131085 with English translation.

Chinese Office Action, dated Jan. 23, 2015, in corresponding Chinese Patent Application No. 201280064470.3.

Japanese Office Action, dated Nov. 11, 2014, in corresponding Japanese Patent Application No. 2013-551240.

International Preliminary Report on Patentability—PCT/JP2012/008267—dated Jul. 1, 2014.

Chinese Office Action dated Mar. 14, 2018 in corresponding Chinese Patent Application No. 201610828867.5 with concise statement of relevance of Chinese Office Action.

European Office Action dated Jul. 24, 2018 in corresponding European Patent Application No. 12863241.1.

JP Office Action dated May 12, 2015, with English Translation; Application No. 2013-551240.

KR Office Action dated May 20, 2015, with English Translation; Application No. 10-2014-7018725.

EESR dated Jun. 30, 2015; Application No. 12863241.1.

International Search Report PCT/JP2012/008267 dated Apr. 9, 2013.

Chinese Office Action, dated Jun. 13, 2019, in corresponding Chinese Patent Application No. 201610828867.5 with concise statement of relevance of Chinese Office Action.

KR Office Action, dated Dec. 9, 2015; Application No. 10-2014-7018725.

* cited by examiner

DEVICE TO IMPROVE IRON LOSS PROPERTIES OF GRAIN-ORIENTED ELECTRICAL STEEL SHEET

TECHNICAL FIELD

The present invention relates to a device to improve iron loss properties of a grain-oriented electrical steel sheet by subjecting the grain-oriented electrical steel sheet to magnetic domain refining treatment.

BACKGROUND ART

A grain-oriented electrical steel sheet is mainly utilized as an iron core of a transformer and required to exhibit superior magnetization characteristics, e.g. low iron loss in particular.

In this regard, it is important to highly accumulate secondary recrystallized grains of a steel sheet in (110)[001] orientation, i.e. what is called "Goss orientation", and to reduce impurities in a product steel sheet. However, there are restrictions on controlling crystal grain orientations and reducing impurities, in view of production cost. Accordingly, there has been developed a technique of introducing non-uniformity (strain) into a surface of a steel sheet by physical means to subdivide width of magnetic domains to reduce iron loss, i.e., magnetic domain refinement technique.

For example, JP S57-2252 A (PTL 1) proposes a technique of irradiating a steel sheet as a finished product with a laser beam to introduce linear high-dislocation density regions into a surface layer of the steel sheet, thereby narrowing magnetic domain widths and reducing iron loss of the steel sheet. The magnetic domain refinement technique using laser-beam irradiation of PTL 1 was improved thereafter (see JP 2006-117964 A (PTL 2), JP H10-204533 A (PTL 3), and JP H11-279645 A (PTL 4)), so that a grain-oriented electrical steel sheet having good iron loss properties can be obtained.

A device for irradiating a laser beam as described above needs to have a function of linearly irradiating a laser beam in the width direction (direction orthogonal to the rolling direction) of the steel sheet. For example, JP 561-48528 A (PTL 5) discloses a method of using an oscillating mirror, and JP 561-203421 A (PTL 6) discloses a method of using a rotary polygon mirror, each of which is a method for scanning a laser beam in the width direction of a steel sheet under specific conditions.

Meanwhile, JP H06-072266 B (PTL 7) proposes a technology of controlling the width of magnetic domains through irradiation of an electron beam. According to this method, which reduces iron loss through irradiation of an electron beam, the electron beam can be scanned at high speed through magnetic field control, which means that the method involves no mechanical moving element that is employed otherwise in an optical scanning mechanism for a laser beam. Therefore, the method is particularly advantageous in continuously irradiating an electron beam at high speed onto a continuous strip having a wide width of 1 m or more.

CITATION LIST

Patent Literature

PTL 1: JP 557-2252 A
PTL 2: JP 2006-117964 A
PTL 3: JP H10-204533 A

PTL 4: JP H11-279645 A
PTL 5: JP S61-48528 A
PTL 6: JP S61-203421 A
PTL 7: JP H06-072266 B

SUMMARY OF INVENTION

Technical Problem

In order to continuously irradiate a laser beam under the same conditions onto a strip of a grain-oriented electrical steel sheet using the devices proposed as above, the sheet passing speed of the strip needs to be maintained constant. However, in the industrial production, there often arises a need to decelerate the passage of the strip at the entry side or at the exit side of the production line along which the laser-beam irradiation is carried out, in order for exchanging the coil of the strip (coiled strip) and adjusting/inspecting the in-line facilities. Thus, it has been necessary to introduce, in tandem, an extensive system such as a looper in order to allow the strip to be passed at a constant speed at the center of the line for laser-beam irradiation.

The present invention has been made in view of the aforementioned circumstances, and an object of the present invention is to provide a device constitution capable of reliably carrying out refinement of magnetic domains by high-energy-beam irradiation with a laser beam, an electron beam, or the like in a grain-oriented electrical steel sheet even when the sheet passing speed of the grain-oriented electrical steel sheet changes.

Solution to Problem

In recent years, there have been developed laser oscillators excellent in controllability, such as a semiconductor laser and a fiber laser, which can readily control, at high responsivity, the value of power and ON/OFF of the power of laser beams to be oscillated. Accordingly, these properties of those lasers can fully be enjoyed if an irradiation apparatus capable of responding flexibly to the changes in sheet passing speed of a grain-oriented electrical steel sheet is made available, offering benefits of simplifying the facilities and increasing the degree of freedom in operation.

Further, even in the case of electron-beam irradiation, it can similarly be expected that the facilities can be simplified and the degree of freedom in operation can be increased if the irradiation can flexibly deal with the changes in the sheet passing speed of a grain-oriented electrical steel sheet.

In view of the above, the inventors of the present invention have given consideration to possible constitutions for a device to improve iron loss properties of a grain-oriented electrical steel sheet, the device being capable of iteratively irradiating, at arbitrary intervals, a high-energy beam such as a laser beam and an electron beam correspondingly to the sheet passing speed of the grain-oriented electrical steel sheet, and come to complete the present invention.

Specifically, primary features of the present invention are as follows.

(1) A device to improve iron loss properties of a grain-oriented electrical steel sheet, which scans a high-energy beam in a direction traversing a feed path of a grain-oriented electrical steel sheet having subjected to final annealing so as to irradiate a surface of the steel sheet being passed through with the high-energy beam to thereby perform magnetic domain refinement, the device including:

an irradiation mechanism for scanning the high-energy beam in a direction orthogonal to the feed direction of the steel sheet, in which the irradiation mechanism has a function of having the scanning direction of the high-energy beam oriented diagonally, relative to the orthogonal direction, toward the feed direction of the steel sheet at an angle determined based on a sheet passing speed of the steel sheet on the feed path.

(2) The device to improve iron loss properties of a grain-oriented electrical steel sheet according to said aspect (1), in which the high-energy beam is a laser beam.

(3) The device to improve iron loss properties of a grain-oriented electrical steel sheet according to said aspect (2), in which the irradiation mechanism includes a scanning mirror for the laser beam, the scanning mirror being disposed such that an optical path length defined between the scanning mirror and the steel sheet is 300 mm or more.

(4) The device to improve iron loss properties of a grain-oriented electrical steel sheet according to said aspect (2) or (3), further including a fiber for transmitting the laser beam from an oscillator to an optical system for laser beam irradiation, the fiber having a core diameter of 0.1 mm or less.

(5) The device to improve iron loss properties of a grain-oriented electrical steel sheet according to said aspect (1), in which the high-energy beam is an electron beam.

(6) The device to improve iron loss properties of a grain-oriented electrical steel sheet according to said aspect (5), in which the irradiation mechanism includes a deflection coil for the electron beam, the deflection coil being disposed such that a distance defined between the deflection coil and the steel sheet is 300 mm or more.

Advantageous Effect of Invention

The use of the device to improve iron loss properties of the present invention for carrying out laser-beam irradiation onto a grain-oriented electrical steel sheet being passed allows magnetic domain refinement through laser-beam irradiation to be reliably performed even when the sheet passing speed of the grain-oriented electrical sheet changes. Therefore, there can be stably produced a grain-oriented electrical steel sheet with low iron loss properties.

BRIEF DESCRIPTION OF DRAWINGS

The present invention will be further described below with reference to the accompanying drawings, wherein.

DESCRIPTION OF EMBODIMENTS

In the following, a device to improve iron loss properties according to the present invention is specifically described with reference to the drawings.

Figure 1:
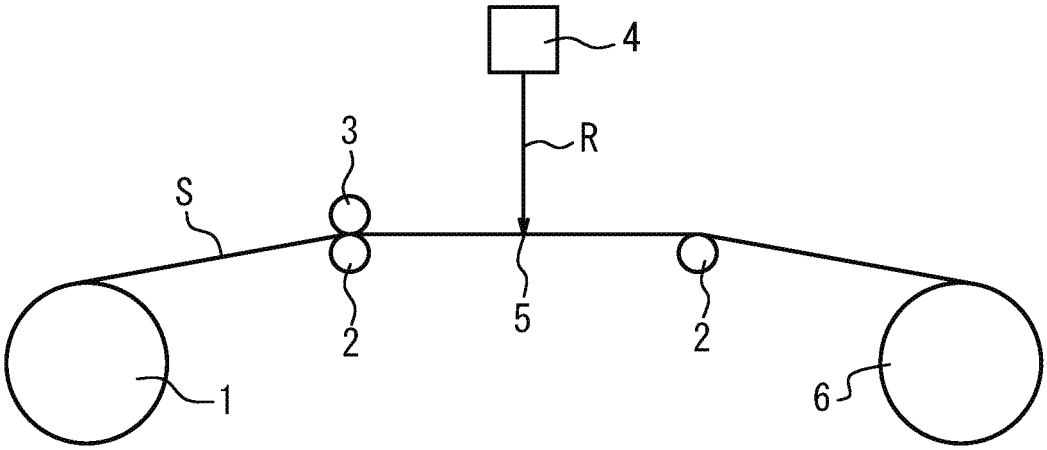
FIG. 1 is a schematic view illustrating a device to improve iron loss properties according to the present invention.

FIG. 1 illustrates a basic configuration of the device to improve iron loss according the present invention. As illustrated in FIG. 1, the device is configured to irradiate, in the process of paying off a grain-oriented electrical steel sheet having subjected to final annealing (which steel sheet will simply be referred to as a '(electrical) steel sheet' hereinafter) S from a pay-off reel 1 to pass through the steel sheet S between the support rolls 2, 2, a laser beam R from a laser beam irradiation mechanism 4 toward a laser beam irradiation part 5 on the steel sheet S, to thereby perform magnetic domain refinement. The steel sheet S having subjected to magnetic domain refinement through laser-beam irradiation is wound on a tension reel 6. Here, in the illustrated example, a measuring roll 3 serves to measure the sheet passing speed of the steel sheet S between the support rolls 2, 2.

In order to subject the steel sheet S to magnetic domain refinement through laser-beam irradiation, the steel sheet S being fed and passed through between the support rolls 2, 2 needs to be irradiated with a laser beam in a direction orthogonal to the rolling direction thereof (hereinafter, referred to as transverse direction), which means that the laser-beam irradiation must be oriented diagonally from the transverse direction toward the feed direction correspondingly to the sheet passing speed of the steel sheet S. For this purpose, the device according to the present invention is configured to have a laser beam irradiation mechanism illustrated in below so as to implement laser irradiation that allows the irradiated laser beam to keep pace with the sheet passage of the steel sheet S.

First, the aforementioned device needs to be provided with a function of detecting the sheet passing speed of the steel sheet S at the laser beam irradiation part 5. Specific techniques available for implementing the function include: a detection technique using the measuring roll 3 illustrated; a technique using a bridle roll or other rolls each having a peripheral speed coinciding with the sheet passing speed of the steel sheet so as to detect the number of revolutions of the roll, based on which the sheet passing speed is determined; and a technique of determining the sheet passing speed, based on the number of revolutions of the pay-off reel or the tension reel, and the diameter of the wound coil (actual or calculated value).

Figure 2A:
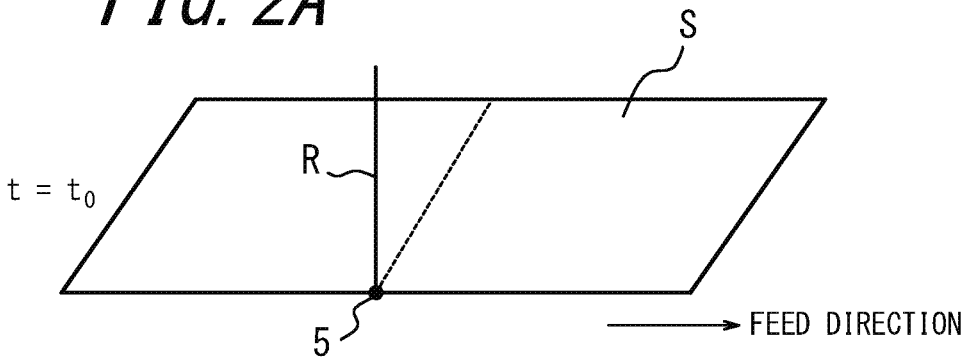
FIG. 2A is a view illustrating how a laser beam is scanned according to this disclosure.
Figure 2B:
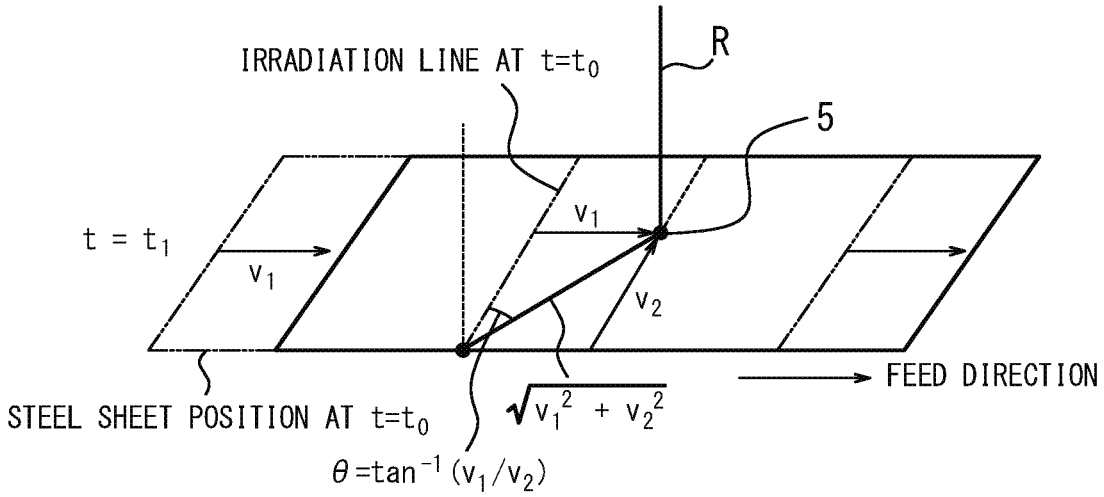
FIG. 2B is a view illustrating how a laser beam is scanned according to this disclosure.

Here, in irradiating a laser beam R in the transverse direction of the steel sheet S as illustrated by the dashed line of FIG. 2A for magnetic domain refinement, there may be employed an irradiation mechanism for reliably scanning the laser beam R in the width direction of the steel sheet S being passed through, which is now described in detail in below. Specifically, assuming an exemplary case where a single scanning mechanism is employed to scan a laser beam along the length w (m) in the width direction, as in FIG. 2B which illustrates how a laser beam R is irradiated onto the steel sheet S being fed, there may be additionally provided, to an irradiation mechanism for scanning the laser beam R at a scanning rate of $v_2$ (m/s) in a direction orthogonal to the feed direction of the steel sheet S, a function of scanning the laser beam R at a scanning rate of $v_1$ (m/s) in the sheet passing direction so that the laser beam R is irradiated in such a manner as to keep pace with the steel sheet S, in order to reliably scan the laser beam R onto the steel sheet S in the width direction thereof (transverse direction), where $v_1$ (m/s) is the sheet passing speed of the steel sheet S and $v_2$ (m/s) is the scanning rate of a laser beam in the transverse direction of the steel sheet.

The length w in the width direction, which is scanned and irradiated with one laser beam, is constrained by, for example, the number of laser oscillators, the time required to scan the one laser beam (which is determined based on the scanning rate $v_2$, a computation time for control, an operating time of the scanning mirror, and the like), and the acceptable margin for the beam shape distortion at the edge of the scanning region. Thus, the length w is generally designed to be in a range of 50 mm to 500 mm.

The scanning rate $v_2$, which is adjusted to satisfy a condition for providing a steel sheet with a strain distribution appropriate for magnetic domain refinement, is determined based either on the laser power, the irradiation spot interval, and the pulse recurrence frequency in the case where the laser beam is pulsed, or on the laser power and the beam spot diameter in the case where the laser beam is continuous.

As described above, the laser beam R is scanned at the scanning rate $v_2$ (m/s) in a direction orthogonal to the feed direction of the steel sheet S while being scanned at the scanning rate $v_1$ (m/s) in the sheet passing direction so as to keep pace with the steel sheet S, to thereby allow the laser beam R to be oriented diagonally toward the feed direction, relative to the feed direction and the orthogonal direction at an angle of $\theta=\tan^{-1}(v_1/v_2)$.

An irradiation mechanism suited for orienting the laser beam scanning as described above is configured to include, for example, a scanning mirror for scanning the laser beam in a direction orthogonal to the feed direction and a vibrating (oscillating) mirror or a rotating polygon mirror disposed in proximity to the scanning mirror. In other words, the vibrating mirror or the rotating polygon mirror disposed in proximity to the scanning mirror causes the laser beam R to be scanned at the scanning rate $v_1$ (m/s) in the sheet passing direction.

Alternatively, there may be employed an irradiation mechanism for scanning a laser beam in a direction orthogonal to the feed direction, in which the laser beam is scanned diagonally relative to the orthogonal direction at an angle of $\theta=\tan^{-1}(v_1/v_2)$ while the scanning rate is controlled to $(v_1^2+v_2^2)^{1/2}$, so as to have the laser beam oriented as described above.

In either mechanism, the optical path length between the scanning mirror and the steel sheet at the beam spot is preferably defined to be 300 mm or more with a view to ensuring equal energy density across the entire scanning region of the laser beam. Specifically, if the optical path length is short, for example, the laser beam is irradiated as being tilted at a large angle of inclination at the edge portion in the width direction of the steel sheet, with the result that the irradiated beam spot is changed in shape from circular to ellipsoidal so as to be enlarged in area, as compared to that of the center portion. As a result, the irradiation at the edge portion in the width direction becomes lower in energy density than the irradiation at the center portion in the width direction, which is not preferred. Therefore, the optical path length is preferably defined to be 300 mm or more.

On the other hand, the optical path length is preferably defined to be 1200 mm or shorter for the purpose of preventing the irradiation portion from being displaced due to vibration or the like, and of implementing the installation of a cover that contributes to ensuring safety and cleanliness.

Preferred examples of the laser oscillator may include, for example, a fiber laser, a disk laser, and a slab $CO_2$ laser, which are each capable of oscillating a highly focused laser beam, in order to maintain the convergence of the laser beam along the aforementioned long optical path length. There is no limitation on whether the laser is of the pulsed oscillation type or of the continuous oscillation type. In particular, an exemplary oscillator that can be more suitably used in the present invention includes, for example, a single mode fiber laser capable of providing a laser beam that is excellent in convergence and has a wavelength available for fiber transmission, because it allows for easy application of a transmission fiber with a core diameter of 0.1 mm or less.

Thermal strain resulting from laser beam irradiation may be either in a continuous line-like pattern or in a one-dot line-like pattern. Such linear, strain-introduced areas are formed iteratively in the rolling direction with an interval in a range of 2 mm to 20 mm (inclusive of 2 mm and 20 mm) therebetween, and the optimum interval thereof is adjusted based on the grain diameter of the steel sheet and the displacement angle of the <001> axis from the rolling direction.

Examples of preferred laser beam irradiation conditions include, in a case of Yb fiber laser, for example, irradiating a steel sheet with a laser beam with the power of 50 W to 500 W and the irradiated beam spot diameter of 0.1 mm to 0.6 mm, such that a unit of linear irradiation marks formed in the transverse direction in a continuous line-like pattern at 10 m/s is repeatedly formed in the rolling direction with an interval of 2 mm to 10 mm between adjacent units.

In the examples illustrated above, the high-energy beam is exemplified by a laser beam. However, an electron beam can be irradiated similarly to the aforementioned laser beam by controlling the irradiation thereof so as to be diagonally oriented at an angle of θ with respect to a direction orthogonal to the feed direction of the steel sheet, to thereby maintain the irradiation pattern constant despite arbitrary changes in the feeding speed.

An exemplary system suited for implementing the irradiation control as described above may include, for example, an irradiation mechanism having a first deflection coil combined with a second deflection coil, the first deflection coil yielding a magnetic field to cause an electron beam to be scanned in a direction orthogonal to the steel sheet feed direction, the second deflection coil deflecting the electron beam in the steel sheet feed direction.

Alternatively, the deflection coil for causing an electron beam to be scanned in a direction orthogonal to the steel sheet feed direction may additionally be inclined relative to the orthogonal direction at an angle of $\theta=\tan^{-1}(v_1/v_2)$ while the scanning rate is controlled to $(v_1^2+v_2^2)^{1/2}$, to thereby control the irradiation as described above. In this case, an electron gun incorporating the deflection coil may integrally be inclined at an angle of θ. Still alternatively, there may be employed a method of rotating the deflection direction of an electron beam through application of an electric field parallel to the center axis of the beam by a coil wound around the beam, which is a rotation angle adjustment with the use of a so-called rotary correcting coil.

Even in the case of electron-beam irradiation, the distance between the deflection coil for an electron beam and the steel sheet is preferably defined to be 300 mm or more with a view to ensuring equal energy density across the entire scanning region of the electron beam. On the other hand, the distance between the deflection coil and the steel sheet is preferably defined to be 1200 mm or less with a view to suppressing the beam diameter expansion.

The method for improving iron loss properties of a grain-oriented electrical steel sheet of the present invention is applicable to any conventionally-known grain-oriented electrical steel sheets as long as the method is applied to the steel sheet that has already been subjected to final annealing and formation of tension coating processes. That is, the steel sheet needs to be heat-treated at high temperature for final annealing for facilitating secondary recrystallization in Goss orientation, formation of tension insulating coating, and actual expression of a tension effect by the tension coating, which are the features of a grain-oriented electrical steel sheet. Such treatment at high temperature, however, relieves or decreases strains introduced to the steel sheet. For this reason, the steel sheet therefore must be subjected to the heat treatment described above, prior to magnetic domain refining treatment of the present invention.

Further, the higher degree of accumulation or alignment in secondary recrystallization in a grain-oriented electrical steel sheet having subjected to magnetic domain refining treatment results in lower iron loss of the electrical steel sheet. $B_8$ (magnetic flux density when a steel sheet is magnetized at 800 A/m) is often used as an index of the degree of orientation accumulation of an electrical steel sheet. In this regard, a grain-oriented electrical steel sheet for use in the present invention preferably exhibits $B_8$ of 1.88 T or more, and more preferably $B_8$ of 1.92 T or more.

Tension insulting coating provided on a surface of an electrical steel sheet may be conventional tension insulating coating, in the present invention. The tension insulating coating is preferably glassy coating mainly composed of aluminum phosphate/magnesium phosphate and silica.

As described above, the present invention relates to a device for carrying out strain-introducing treatment to a grain-oriented electrical steel sheet having subjected to annealing for secondary recrystallization which is followed by formation of tension insulating coating. Accordingly, regarding materials of the grain-oriented electrical steel sheet, those for use in a conventional grain-oriented electrical steel sheet may suffice. For example, materials containing Si: 2.0 mass % to 8.0 mass % for use in electrical steel may be used, and the content thereof is defined to fall within the aforementioned range due to the following reasons.

Si: 2.0 Mass % to 8.0 Mass %

Silicon (Si) is an element which effectively increases electrical resistance of steel to improve iron loss properties thereof. Si content in steel falling below 2.0 mass % cannot ensure a sufficient effect of reducing iron loss. On the other hand, Si content in steel equal exceeding 8.0 mass % significantly deteriorates formability and magnetic flux density of a resulting steel sheet. Accordingly, Si content in steel is preferably in the range of 2.0 mass % to 8.0 mass %.

Specific examples of basic components and other components to be optionally added, in addition to Si, to the grain-oriented electrical steel sheet of the present invention are as follows.

C: 0.08 Mass % or Less

Carbon (C) is added to improve texture of a hot rolled steel sheet. C content in steel is preferably 0.08 mass % or less because C content exceeding 0.08 mass % increases burden of reducing, during the manufacturing process, C content to 50 mass ppm or less at which magnetic aging is reliably prevented. There is no need to particularly set the lower limit of C content because secondary recrystallization is possible even in a material not containing carbon.

Mn: 0.005 Mass % to 1.0 Mass %

Manganese (Mn) is an element which advantageously achieves good hot-formability of a steel sheet. Mn content in a steel sheet less than 0.005 mass % cannot cause the good effect of Mn addition sufficiently. Mn content in a steel sheet exceeding 1.0 mass % deteriorates magnetic flux density of a product steel sheet. Accordingly, Mn content in a steel sheet is preferably in the range of 0.005 mass % to 1.0 mass %.

When an inhibitor is to be used for facilitate secondary recrystallization, chemical composition of material steel for the grain-oriented electrical steel sheet of the present invention may contain, for example, appropriate amounts of Al and N in a case where an AlN-based inhibitor is utilized or appropriate amounts of Mn and Se and/or S in a case where MnS and/or MnSe-based inhibitor is utilized. Both AlN-based inhibitor and MnS and/or MnSe-based inhibitor may be used in combination, of course. When the inhibitors are used in combination, contents of Al, N, S and Se are preferably Al: 0.01 mass % to 0.065 mass %. N: 0.005 mass % to 0.012 mass %, S: 0.005 mass % to 0.03 mass %. and Se: 0.005 mass % to 0.03 mass %, respectively.

The present invention is also applicable to a grain-oriented electrical steel sheet not using any inhibitor and having restricted Al, N, S, and Se contents in the material steel sheet thereof.

In this case, the contents of Al, N, S, and Se are preferably suppressed to Al: 100 mass ppm or less, N: 50 mass ppm or less, S: 50 mass ppm or less, and Se: 50 mass ppm or less, respectively.

Further, the grain-oriented electrical steel sheet of the present invention may contain, for example, following elements as magnetic properties improving components, in addition to the basic components described above.

At Least One Element Selected from Ni: 0.03 Mass % to 1.50 Mass %, Sn: 0.01 Mass % to 1.50 Mass %, Sb: 0.005 Mass % to 1.50 Mass %, Cu: 0.03 Mass % to 3.0 Mass %, P: 0.03 Mass % to 0.50 Mass %, Mo: 0.005 Mass % to 0.10 Mass %, and Cr: 0.03 Mass % to 1.50 Mass %

Nickel (Ni) is a useful element in terms of further improving texture of a hot rolled steel sheet and thus magnetic properties of a resulting steel sheet. However, Ni content in steel less than 0.03 mass % cannot sufficiently cause this magnetic properties-improving effect by Ni, whereas Ni content in steel exceeding 1.5 mass % fails ensure stability in secondary recrystallization and thus impairs magnetic properties of a resulting steel sheet. Accordingly, Ni content in steel is preferably in the range of 0.03 mass % to 1.5 mass %.

Sn, Sb, Cu, P, Cr, and Mo are useful elements, respectively, in terms of further improving magnetic properties of the grain-oriented electrical steel sheet of the present invention. Contents of these elements lower than the respective lower limits described above result in an insufficient magnetic properties-improving effect. Contents of these elements exceeding the respective upper limits described above inhibit the optimum growth of secondary recrystallized grains. Accordingly, it is preferred that the grain-oriented electrical steel sheet of the present invention contains those elements within the respective ranges thereof specified above.

The balance other than the aforementioned components of the grain-oriented electrical steel sheet of the present invention is Fe and incidental impurities incidentally mixed thereinto during the manufacturing process.

EXAMPLES

Example 1

A steel sheet wound out of a coil of a grain-oriented electrical steel sheet having a thickness of 0.23 mm and a width of 300 mm and subjected to final annealing and coating and baking of tension insulating coating was continuously irradiated with a laser beam as being continuously fed to a device to improve iron loss properties of the steel sheet of FIG. 1.

Figure 3:
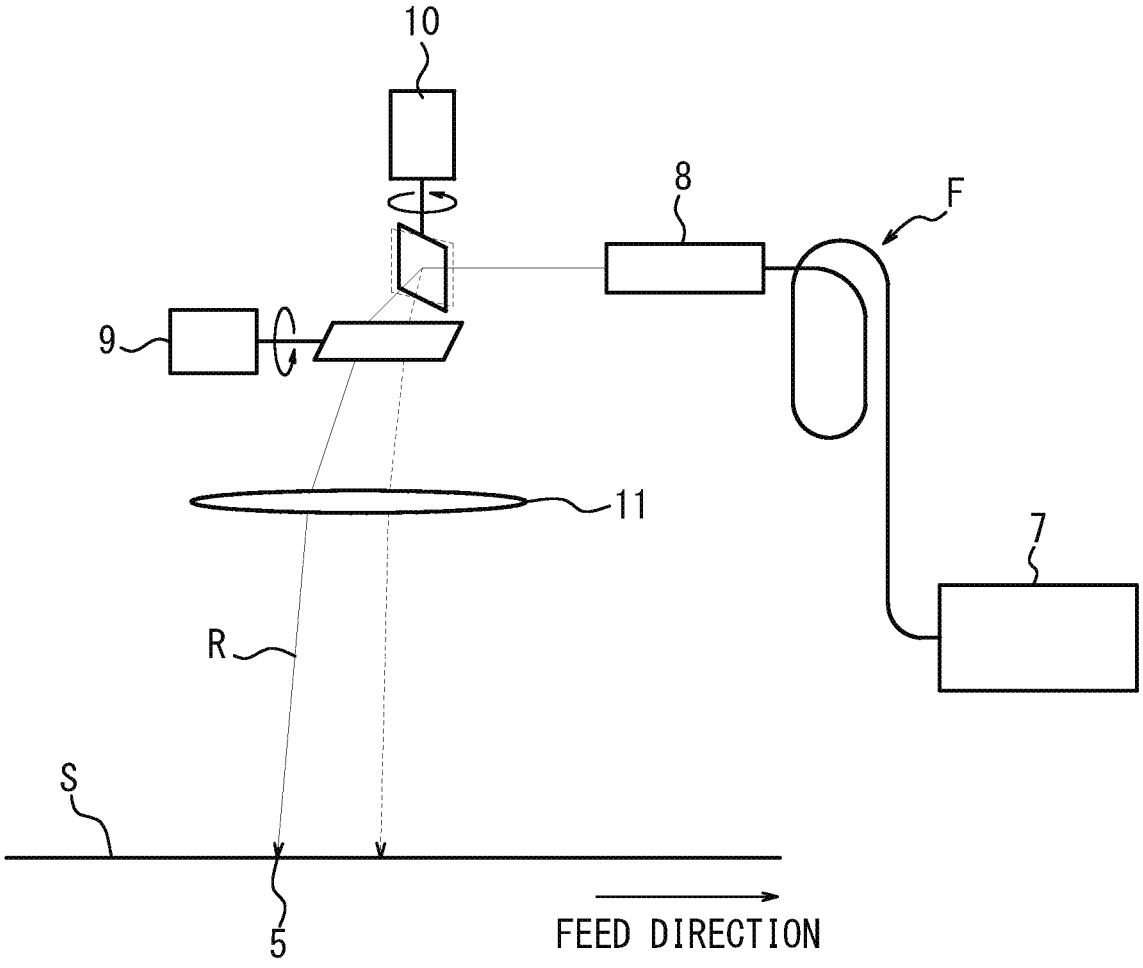
FIG. 3 is a view illustrating a main part of the device to improve iron loss properties according to the present invention.

Here, the laser beam irradiation mechanism constituting an essential part of the device to improve iron loss properties of a steel sheet includes, as illustrated in FIG. 3: two vibrating mirrors (galvano mirrors) 9 and 10 for scanning laser beams aligned as parallel light beams by a collimator 8 each in the width direction and the rolling direction of the steel sheet S, respectively; and an fθ lens 11. Specifically, the following operation was performed for scanning, by the former mirror 9, a beam spot in the width direction at a constant rate while the laser beam was controlled, by the latter mirror 10, so as to be diagonally oriented with respect to the width direction, toward the feed direction correspondingly to a specific angle calculated from the sheet passing speed.

A laser oscillator 7 was a single-mode Yb fiber laser, in which a laser beam was guided to the collimator 8 via a transmission fiber F having a core diameter of 0.05 mm, and the beam diameter after passing through the collimator 8 was adjusted to 8 mm and the beam diameter on the steel sheet was adjusted to be in a circular shape of 0.3 mm. The fθ lens 11 had a focal length of 400 mm, and an optical path length from the first galvano mirror to the steel sheet was 520 mm.

The grain-oriented electrical steel sheets used in Examples and Comparative Examples were conventional, highly grain-oriented electrical steel sheet each having Si content of 3.4 mass %, magnetic flux density ($B_8$) at 800 A/m of 1.935 T or 1.7 T and exhibiting iron loss at 50 Hz ($W_{17/50}$) of 0.90 W/kg, and conventional tension insulating coating provided thereon by baking, at 840° C., coating liquid composed of colloidal silica, magnesium phosphate and chromic acid, applied on forsterite coating.

In the irradiation mechanism configured as described above, the beam spot was iteratively and linearly scanned at $v_2$=10 m/s in the width direction with the laser power of 100 W at the irradiation interval of 5 mm. The beam spot was scanned in the feed direction in such a manner that the scanning rate at the time of irradiation was controlled to be the same as the sheet passing speed $v_1$ measured by the measuring roll 3 so as to cancel the sheet passing speed $v_1$. Despite that the sheet passing speed $v_1$ was either accelerated or decelerated to an arbitrary rate in a range of 5 m/minute to 15 m/minute, the irradiation angle on the steel sheet remained aligned in the width direction of the steel sheet, without causing any fluctuation in iron loss properties of the steel sheet.

Example 2

A steel sheet wound out of a coil of a grain-oriented electrical steel sheet having thickness of 0.23 mm and width of 300 mm and subjected to final annealing and coating and baking of tension insulating coating was continuously irradiated with a laser beam as being continuously fed to the device to improve iron loss properties of the steel sheet of FIG. 1.

Figure 4:
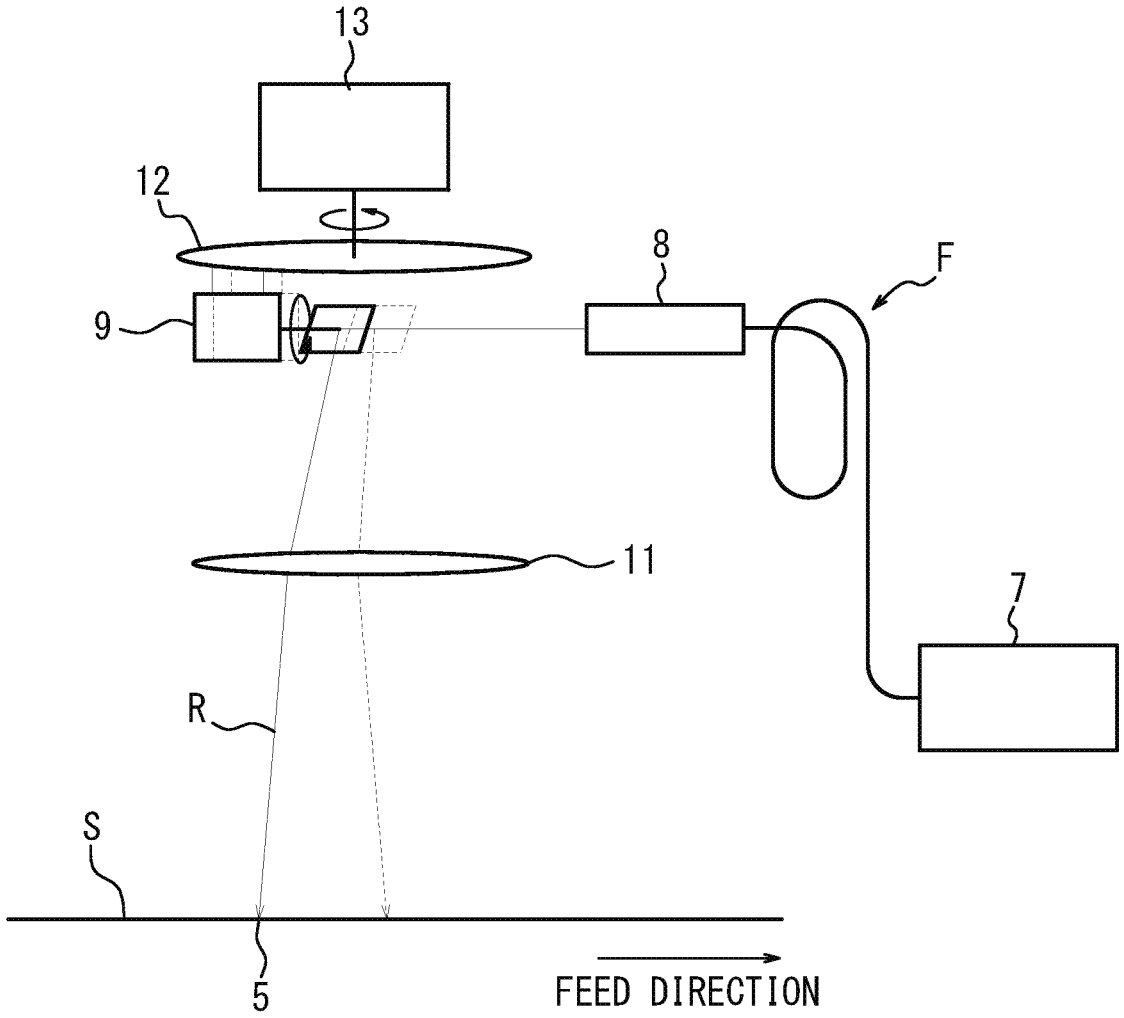
FIG. 4 is a view illustrating a main part of another device to improve iron loss properties according to the present invention.

Here, the laser beam irradiation mechanism constituting an essential part of the device to improve iron loss properties of a steel sheet includes, as illustrated in FIG. 4: one vibrating mirror (galvano mirror) 9 for scanning laser beams aligned as parallel light beams by the collimator 8 in the width direction the steel sheet S; a rotary stage 12 for changing the scanning direction of the mirror 9 to an arbitrary angle relative to the width direction and a motor 13 therefor; and the fθ lens 11. Specifically, the following operation was performed for scanning, by the former mirror 9, a beam spot in the width direction at a constant rate while the laser beam was controlled, by the rotary stage 12, so as to be diagonally oriented, with respect to the width direction, toward the feed direction correspondingly to a specific angle calculated from the sheet passing speed.

A laser oscillator 7 was a single-mode Yb fiber laser, in which a laser beam was guided to the collimator 8 via the transmission fiber F having a core diameter of 0.05 mm, and the beam diameter after passing through the collimator 8 was adjusted to 8 mm and the beam diameter on the steel sheet was adjusted to be in a circular shape of 0.3 mm. The fθ lens 11 had a focal length of 400 mm, and an optical path length from the first galvano mirror to the steel sheet was 520 mm.

The grain-oriented electrical steel sheets used in Examples and Comparative Examples were conventional, highly grain-oriented electrical steel sheet each having Si content of 3.4 mass %, magnetic flux density ($B_8$) at 800 A/m of 1.935 T or 1.7 T and exhibiting iron loss at 50 Hz ($W_{17/50}$) of 0.90 W/kg, and conventional tension insulating coating provided thereon by baking, at 840° C., coating liquid composed of colloidal silica, magnesium phosphate and chromic acid, applied on forsterite coating.

In the irradiation mechanism configured as described above, the beam spot was iteratively and linearly scanned at $v_2$=10 m/s in the width direction with the laser power of 100 W at the irradiation interval of 5 mm. The beam spot was scanned in the feed direction in such a manner that the scanning rate at the time of irradiation was controlled to be the same as the sheet passing speed $v_1$ measured by the measuring roll 3 so as to cancel the sheet passing speed $v_1$. Despite that the sheet passing speed $v_1$ was either accelerated or decelerated to an arbitrary rate in a range of 5 m/minute to 15 m/minute, the irradiation angle on the steel sheet remained aligned in the width direction of the steel sheet, without causing any fluctuation in iron loss properties of the steel sheet.

Example 3

Figure 5:
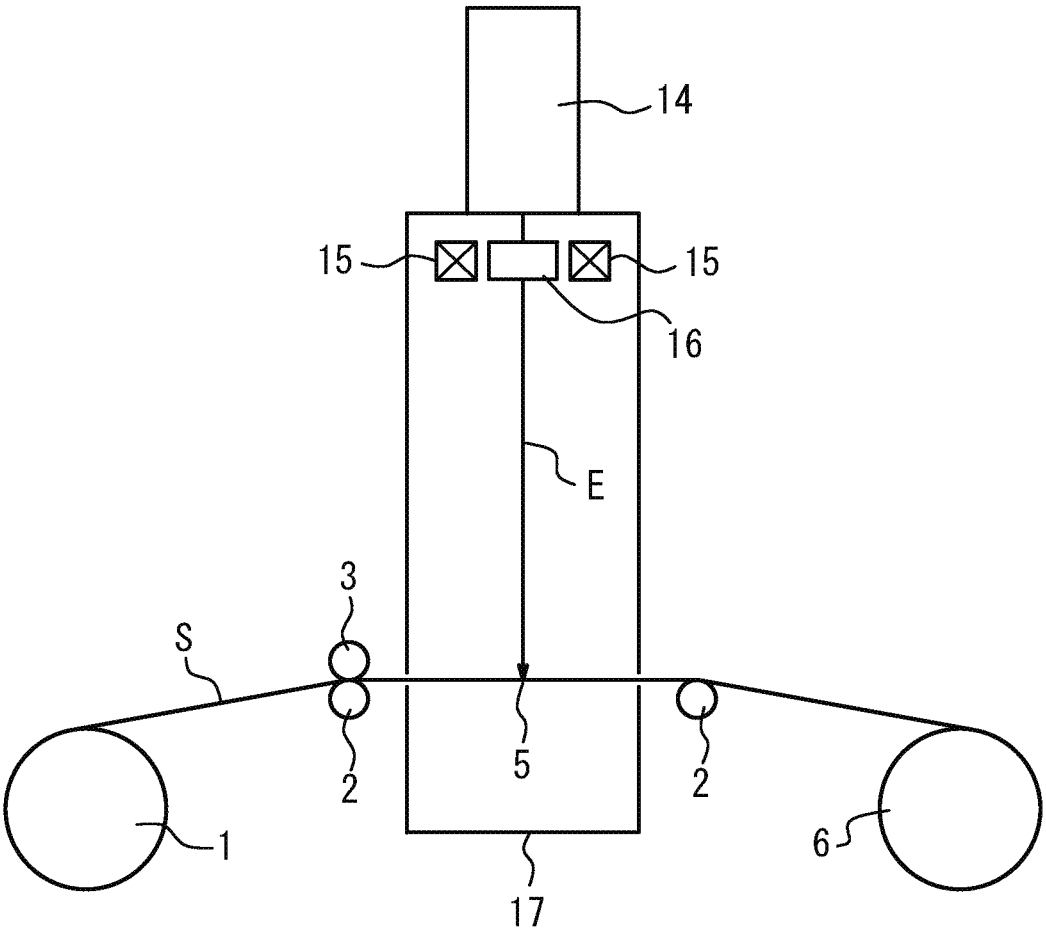
FIG. 5 is a view illustrating a main part of a device to improve iron loss properties with the use of an electron beam, according to the present invention.

A steel sheet wound out of a coil of a grain-oriented electrical steel sheet having thickness of 0.23 mm and width of 300 mm and subjected to final annealing and coating and baking of tension insulating coating was continuously irradiated with an electron beam as being continuously fed to a device to improve iron loss properties of the steel sheet of FIG. 5.

Here, the electron beam irradiation mechanism constituting an essential part of the device to improve iron loss properties of a steel sheet includes, as illustrated in FIG. 5, two deflection coils 15 and 16 each for scanning an electron beam either in the width direction or in the rolling direction of the steel sheet S. Specifically, an operation was performed such that the beam spot was controlled by the former deflection coil 15 so as to be scanned at a constant scanning rate in the width direction of the steel sheet while the beam spot was controlled, by the latter deflection coil 16, so as to be diagonally oriented, with respect to the width direction, toward the feed direction correspondingly to a specific angle calculated from the sheet passing speed.

An electron gun 14 emits an electron beam at a beam accelerating voltage of 60 kV, and is capable of converging the beam diameter to 0.2 mm in just focus on the steel sheet immediately below the electron gun. The distance from the deflection coil 16 to the steel sheet is 500 mm.

The grain-oriented electrical steel sheets used in Examples and Comparative Examples were conventional, highly grain-oriented electrical steel sheet each having Si content of 3.4 mass %, magnetic flux density ($B_8$) at 800 A/m of 1.935 T or 1.7 T and exhibiting iron loss at 50 Hz ($W_{17/50}$) of 0.90 W/kg, and conventional tension insulating coating provided thereon by baking, at 840° C., coating liquid composed of colloidal silica, magnesium phosphate and chromic acid, applied on forsterite coating.

In the irradiation mechanism configured as described above, the beam spot was iteratively and linearly scanned at $v_2$=10 m/s in the width direction with the beam current of 10 mA at the irradiation interval of 5 mm. The beam spot was scanned in the feed direction in such a manner that the scanning rate at the time of irradiation was controlled to be the same as the sheet passing speed $v_1$ measured by the measuring roll 3 so as to cancel the sheet passing speed $v_1$. Despite that the sheet passing speed $v_1$ was either accelerated or decelerated to an arbitrary rate in a range of 5 m/minute to 15 m/minute, the irradiation angle on the steel sheet remained aligned in the width direction of the steel sheet, without causing any fluctuation in iron loss properties of the steel sheet.

REFERENCE SIGNS LIST

S steel sheet
R laser beam
F transmission fiber
E electron beam
1 pay-off reel
2 support roll
3 measuring roll
4 laser beam irradiation mechanism
5 laser beam irradiation part
6 tension reel
7 laser oscillator
8 collimator
9 rolling-direction scanning galvano mirror
10 width-direction scanning galvano mirror
11 fθ lens
12 angular adjustment stage
13 angular adjustment motor
14 electron gun
15 deflection coil (for control in the steel sheet width direction)
16 deflection coil (for control in the steel sheet feeding direction)
17 vacuum chamber

The invention claimed is:

1. A device to improve iron loss properties of a grain-oriented electrical steel sheet as the steel sheet travels, within a transport mechanism for transporting the steel sheet, along a feed direction (X) of the transport mechanism, the steel sheet having a width (w) measured in a transverse direction (Y) orthogonal to the feed direction (X), the device comprising:

a measuring device that measures a variable sheet passing speed ($v_1$) of the steel sheet travelling in the feed direction (X) through the transport mechanism; and an irradiation mechanism for irradiating a surface portion of the surface of the grain-oriented electrical steel sheet as the surface portion advances past the irradiation mechanism, the irradiation mechanism configured to scan a high-energy electron beam along the surface portion from a first edge of the steel sheet to an opposite second edge of the steel sheet in a direction angled relative to the transverse direction (Y), an angle (θ) of the scan with respect to the transverse direction (Y) corresponding to the measured sheet passing speed ($v_1$) on the feed path, and the irradiation mechanism configured to adjust the angle (θ) of the scan in proportion to the measured sheet passing speed ($v_1$), so as to maintain an irradiation pattern of the electron beam on the surface portion of the steel sheet that keeps pace with the measured sheet passing speed ($v_1$), wherein the angle (θ) of the scan of the electron beam is $\theta=\tan^{-1}(v_1/v_2)$, wherein $v_1$ is the measured sheet passing speed of the steel sheet, and wherein $v_2$ is a scanning rate of the electron beam in the transverse direction (Y) of the steel sheet.

2. The device according to claim 1, wherein the irradiation mechanism includes a deflection coil for the electron beam, the deflection coil being disposed such that a distance defined between the deflection coil and the steel sheet is 300 mm or more.

* * * * *